US012551939B2

(12) United States Patent
Kawasaki

(10) Patent No.: US 12,551,939 B2
(45) Date of Patent: Feb. 17, 2026

(54) BENDING METHOD

(71) Applicant: AMADA CO., LTD., Kanagawa (JP)

(72) Inventor: Hidekatsu Kawasaki, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 246 days.

(21) Appl. No.: 18/270,729

(22) PCT Filed: Jan. 12, 2022

(86) PCT No.: PCT/JP2022/000749
§ 371 (c)(1),
(2) Date: Jul. 1, 2023

(87) PCT Pub. No.: WO2022/158352
PCT Pub. Date: Jul. 28, 2022

(65) Prior Publication Data

US 2024/0066579 A1 Feb. 29, 2024

(30) Foreign Application Priority Data

Jan. 20, 2021 (JP) ..... 2021-007214

(51) Int. Cl.
*B21D 5/02* (2006.01)

(52) U.S. Cl.
CPC ..... *B21D 5/0209* (2013.01)

(58) Field of Classification Search
CPC ..... B21D 5/02; B21D 5/0209; B21D 5/16
See application file for complete search history.

(56) References Cited

U.S. PATENT DOCUMENTS

2007/0144232 A1* 6/2007 Shimota ..... B21D 5/0209 72/481.1
2010/0018283 A1* 1/2010 Tidl ..... B21D 5/02 72/386
2014/0283576 A1 9/2014 Jin et al.

FOREIGN PATENT DOCUMENTS

| | | | |
|---|---|---|---|
| AT | 503644 | B1 | 12/2007 |
| CN | 203030713 | U | 7/2013 |
| CN | 207521548 | U | 6/2018 |
| CN | 209664116 | U | 11/2019 |
| EP | 2403664 | B1 | 9/2015 |
| EP | 2481492 | B1 | 4/2016 |
| JP | 06-87028 | A | 3/1994 |

(Continued)

OTHER PUBLICATIONS

Extended European Search Report for corresponding EP Application No. 22742474.4 issued May 24, 2024.

(Continued)

*Primary Examiner* — Teresa M Ekiert
(74) *Attorney, Agent, or Firm* — Renner, Otto, Boisselle & Sklar, LLP

(57) ABSTRACT

A bending method utilizes a die including a V-groove at an upper part thereof, and a punch including a first surface and a second surface at a workpiece pressing portion. In a state of being mounted on an upper table of a press brake, the first surface is parallel to a first groove wall surface of the die mounted on a lower table. An angle formed between the second surface and a perpendicular plane is different from an angle formed between a second groove wall surface and the perpendicular plane. A plate-shaped workpiece placed on the die is bent in a state of being sandwiched between the first groove wall surface and the first surface.

4 Claims, 6 Drawing Sheets

(56) References Cited

FOREIGN PATENT DOCUMENTS

| | | |
|---|---|---|
| JP | 2631813 B2 | 7/1997 |
| JP | 3199991 B2 | 8/2001 |

OTHER PUBLICATIONS

International Search Report for corresponding Application No. PCT/JP2022/000749, mailed Mar. 8, 2022.
Written Opinion for corresponding Application No. PCT/JP2022/000749, mailed Mar. 8, 2022.

* cited by examiner

BENDING METHOD

TECHNICAL FIELD

The present invention relates to a bending method of bending a plate-shaped workpiece.

BACKGROUND ART

Conventionally, as a step of hemming, there is known a step in which an edge portion of a plate-shaped workpiece is bent at an acute angle to form an upright flange (pre-hemming) and the flange is bent inward by performing finish bending (main hemming) (See Patent Literature 1, for example).

CITATION LIST

Patent Literature

Patent Literature 1: Japanese Patent Application Laid-Open Publication No. 6-87028

SUMMARY

When the finish bending is started, a thrust load in accordance with an angle of the flange bent at an acute angle acts on the workpiece. In other words, a force is generated that pushes the workpiece forward (toward a side of an operator). Particularly, the force pushing the workpiece forward becomes larger when the thrust load acting on the workpiece is increased due to the influence of the material, thickness, and the like of the workpiece. In this case, workability of the hemming may be lowered. Further, misalignment of the workpiece with respect to a die may be generated so as to lower the processing accuracy of the bending.

In addition, in order to address this problem, a method of preparing a dedicated die is conceivable so as to reduce the thrust load, that is, to reduce the bending angle when the workpiece is bent at an acute angle. However, in this case, there is a problem of increased cost as the dedicated die is prepared. Furthermore, since it is necessary to use the dedicated die for each acute-angle bending, the workability of the bending is lowered.

A bending method according to an embodiment of the present invention utilizes a die mountable on a lower table of a press brake and including a V-groove including a first groove wall surface and a second groove wall surface at an upper part thereof, and a punch mountable on an upper table of the press brake and including, at a workpiece pressing portion, a first surface and a second surface, the first surface in a state of being mounted on the upper table being parallel to the first groove wall surface of the die in a state of being mounted on the lower table, an angle formed between the second surface and a perpendicular plane being different from an angle formed between the second groove wall surface and the perpendicular plane. A plate-shaped workpiece is placed on the upper part of the die mounted on the lower table. The plate-shaped workpiece is pressed by the workpiece pressing portion of the punch mounted on the upper table of the press brake, and bent in a state of being sandwiched between the first groove wall surface of the V-groove and the first surface of the punch.

According to the bending method described above, it is possible to provide a bending method that can improve workability of bending without using a dedicated die when the bending, which can also be used for preliminary bending and the like of hemming, is performed to the plate-shaped workpiece.

DESCRIPTION OF EMBODIMENT

Figure 1A:
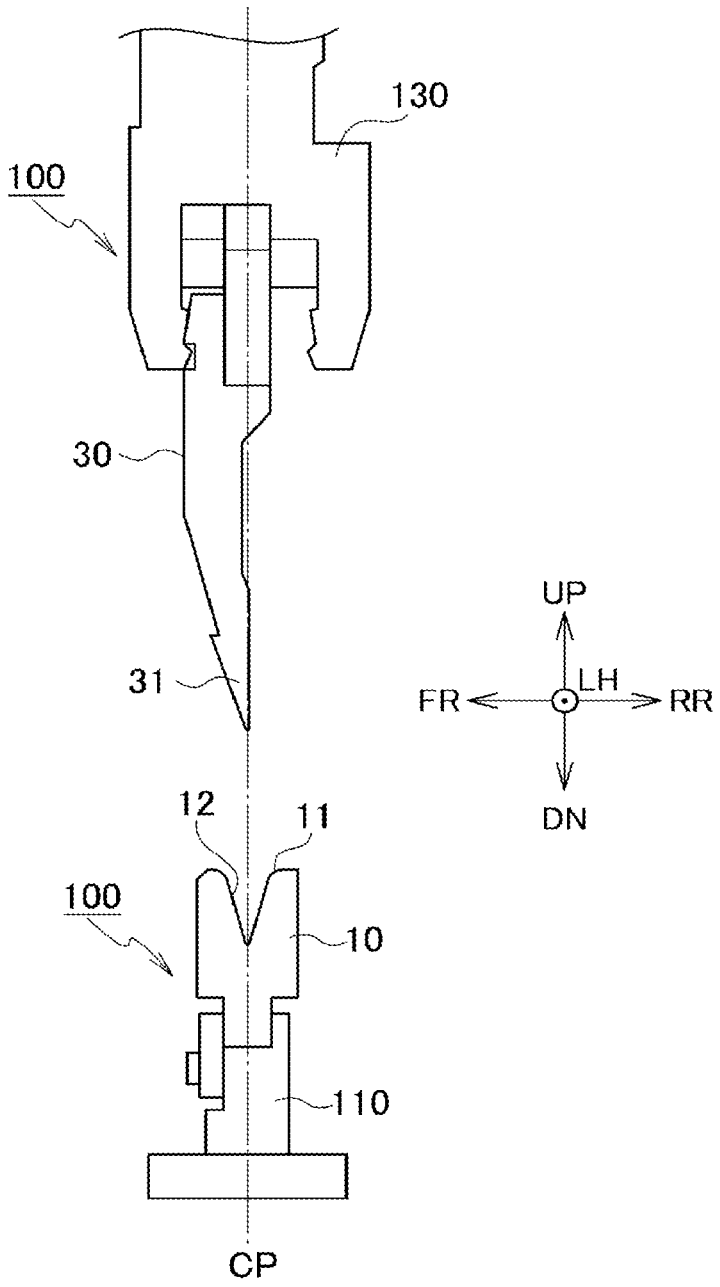
FIG. 1A is a side view showing a state in which a die 10 and a punch 30 used in a bending method according to the present embodiment are attached to a press brake device 100.

Hereinafter, an embodiment will be described based on the drawings. Note that the same or similar reference signs will be given to the same functions and configurations, and the description thereof will be omitted as appropriate.

In the present embodiment, the "lateral direction" is one of the horizontal directions and is a width direction in a state in which a die and a punch are mounted on a press brake (a direction orthogonal to a paper surface in each drawing). The "front-back direction" is a depth direction in a state in which the die and the punch are mounted on the press brake (a lateral direction of the paper surface). The "vertical direction" is a direction orthogonal to the lateral direction and the front-back direction (a vertical direction of the paper surface). Note that in the drawings, the forward direction is described as "FR", the backward direction as "RR", the leftward direction (the front side of the paper surface) as "LH", the upward direction as "UP", and the downward direction as "DN".

(1) Schematic Configuration of Press Brake 100

FIG. 1A is a side view illustrating a state in which a die and a punch used in a bending method according to the present embodiment are attached to a press brake device.

As shown in FIG. 1A, the press brake 100 used in the bending method according to the present embodiment is a press brake for bending a workpiece W of a sheet metal, which can be used for preliminary bending and the like of hemming. A lower table 110 extending in the lateral direction is provided to a lower part of a main body of the press brake 100. A die 10 is mounted on an upper side of the lower table 110 via a die holder so as to be removable and installable. Further, an upper table 130 extending in the lateral direction is provided to an upper part of the main body of the press brake 100 so as to be vertically opposed to the lower table 110 and be vertically movable. A punch 30 is mounted on a lower side of the upper table 130 via a punch holder so as to be removable and installable.

Note that the configuration for vertically moving the upper table 130 may be, for example, a known configuration described in Japanese Patent Application Laid-Open Publication No. 2004-98105, Japanese Patent Application Laid-Open Publication No. 2004-34059, and the like. Further, a servo motor for a table or a hydraulic cylinder (not shown) may be used to move the upper table 130 in the vertical direction. Furthermore, instead of the upper table 130 being configured to be vertically movable, the lower table 110 may be configured to be vertically movable.

(2) Configuration of Die and Punch for Bending

Figure 1B:
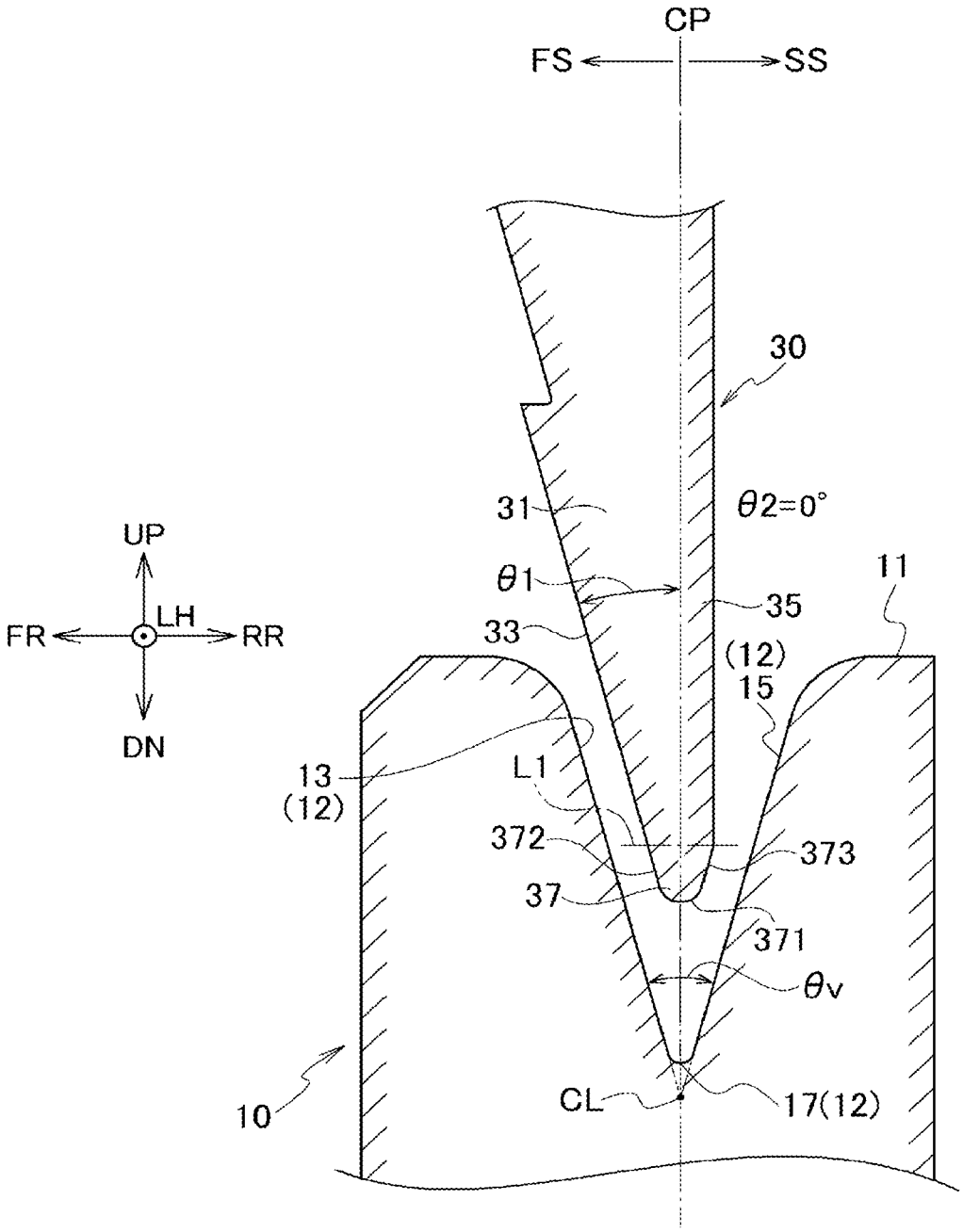
FIG. 1B is an enlarged cross-sectional view of a workpiece pressing portion 31 of the punch 30 and a V-groove 12 of the die 10 shown in FIG. 1A.

FIG. 1B is an enlarged cross-sectional view of a workpiece pressing portion 31 of the punch 30 and a V-groove 12 of the die 10 shown in FIG. 1A.

As shown in FIGS. 1A and 1B, the die 10 used in the bending method according to the present embodiment includes, at an upper part 11 thereof, the V-groove 12 including a first groove wall surface 13 and a second groove wall surface 15. The die 10 is mounted on the lower table 110 of the press brake 100.

Specifically, the die 10 includes the groove 12 extending laterally (in the direction orthogonal to the paper surface of FIG. 1A) at the upper part 11 thereof. As shown in FIG. 1B, the V-groove 12 includes the first groove wall surface 13 and the second groove wall surface 15. The V-groove 12 further includes a groove bottom 17 that connects the first groove wall surface 13 and the second groove wall surface 15 and whose cross-sectional shape perpendicular to the lateral direction is an arch shape.

Further, the first groove wall surface 13 and the second groove wall surface 15 of the V-groove 12 are symmetrical with respect to a first perpendicular plane CP. Here, the first perpendicular plane CP is a perpendicular plane passing through an intersect position CL at which imaginary planes extending downward along the respective groove wall surfaces 13 and 15 of the V-groove 12 intersect with each other. In other words, in the present embodiment, the groove wall surfaces 13 and 15 of the V-groove 12 are inclined such that an angle formed between the first groove wall surface 13 and the first perpendicular plane CP and an angle formed between the second groove wall surface 15 and the first perpendicular plane CP are equal. In the present embodiment, since the cross-sectional shape of the groove bottom 17 perpendicular to the lateral direction is an arc shape, the first perpendicular plane CP is a perpendicular plane that passes through the arc-shaped center of the groove bottom 17.

In the present embodiment, an angle θv formed between the first groove wall surface 13 and the second groove wall surface 15 of the V-groove 12 is an acute angle. Specifically, the angle θv of the angle formed between the first groove wall surface 13 and the second groove wall surface 15 of the V-groove 12 is 30°. At this time, an angle formed between the first groove wall surface 13 and the first perpendicular plane CP and an angle formed between the second groove wall surface 15 and the first perpendicular plane CP are each 15° (θv/2).

However, this angle θv may be set in accordance with the material and thickness of a workpiece to be bent, or the purpose of the bending. The angle θv may be in a range of, for example, 30° or more to 90° or less.

As shown in FIGS. 1A and 1B, the first groove wall surface 13 and the second groove wall surface 15 of the V-groove 12 are flat on a side of the groove bottom 17 of the V-groove 12 and are curved as a ridge line R on a side of the upper part 11 to be smoothly connected to the upper part 11.

The punch 30 used for the bending according to the present embodiment is mounted on the upper table 130 of the press brake 100 so as to be able to advance to the V-groove 12 of the die 10, as shown in Figure LA.

As shown in FIGS. 1A and 1B, the punch 30 includes the workpiece pressing portion 31 that advances to the V-groove 12. Specifically, the punch 30 is configured to advance to and retreat from the V-groove 12 in a state of being mounted on the upper table 130 when the upper table 130 is vertically moved.

As shown in FIG. 1B, in the state of being mounted on the upper table 130, the workpiece pressing portion 31 of the punch 30 includes a first surface 33 and a second surface 35 positioned on an upper side thereof, and a distal end 37 that is positioned on a lower side thereof and is continuous to respective lower ends of the first surface 33 and the second surface 35 at a predetermined position L1 in the vertical direction.

In the state of being mounted on the upper table 130, the first surface 33 is positioned on a first side FS (a left side of the first perpendicular plane CP in FIG. 1B) with respect to the first perpendicular plane CP. The second surface 35 is positioned on a second side SS (a right side of the first perpendicular plane CP in FIG. 1B) with respect to the first perpendicular plane CP.

As shown in FIG. 1B, at the workpiece pressing portion 31 of the punch 30, the first surface 33 is parallel to the first groove wall surface 13 of the die 10 mounted on the lower table 110. An angle θ2 formed between the second surface 35 and a perpendicular plane that is parallel to the first perpendicular plane CP including the lateral direction is different from the angle θv/2 formed between the second groove wall surface 15 and the first perpendicular plane CP. Note that an angle θ1 formed between the first surface 33 and the perpendicular plane including the lateral direction is naturally equal to the angle θv/2 formed between the first groove wall surface 13 and the first perpendicular plane CP (θ1=θv/2).

In the present embodiment, the angle θ1 of the first surface 33 is 15°, and the angle θ2 of the second surface 35 is 0°. In other words, in the state in which the punch 30 is mounted on the upper table 130, the first surface 33 is inclined by 15° to the first side FS with respect to the first perpendicular plane CP. Therefore, the first surface 33 is parallel to the first groove wall surface 13 of the V-groove 12. The second surface 35 is connected to the distal end 37 on the second side SS and is a surface parallel to the first perpendicular plane CP.

In the present embodiment, the distal end 37 of the punch 30 is formed symmetrically with respect to the first perpendicular plane CP in the state in which the punch 30 is mounted on the upper table 130.

Specifically, as shown in FIG. 1B, the distal end 37 of the workpiece pressing portion 31 is provided, at a lower end thereof, with a tip 371 whose cross-sectional shape of a cross section perpendicular to the lateral direction is an arc shape. Then, the distal end 37 includes planar portions 372 and 373 smoothly continuous in a tangential direction of the arc-shaped tip 371 on the first side FS and the second side SS with respect to the first perpendicular plane CP, respectively.

As shown in FIG. 1B, in a state in which the punch 30 is advanced to the V-groove 12, the planar portions 372 and 373 are opposed to and parallel to the first groove wall surface 13 and the second groove wall surface 15 of the V-groove 12, respectively. In the distal end 37, an upper end of the planar portion 372 and an upper end of the planar portion 373, which are also upper ends of the distal end 37, are connected to the first surface 33 and the second surface 35, respectively, at the predetermined position L1 in the vertical direction of the workpiece pressing portion 31.

Note that in the present embodiment, at the predetermined position L1 at which the planar portion 373 of the second side SS and the second surface 35 are connected, the angles formed between the respective surfaces and the perpendicular plane parallel to the first perpendicular plane CP are changed from 15° to 0°. Note that on the first side FS, since the angle formed between the planar portion 372 and the first perpendicular plane CP and the angle formed between the first surface 33 and the first perpendicular plane CP are the same, the planar portion 372 and the first surface 33 extend across the predetermined position L1 to form a single surface. Note that the predetermined position L1 is set in consideration of the thickness of the plate-shaped workpiece W and a desired bending angle of the workpiece W.

(3) Bending Method

Figure 2:
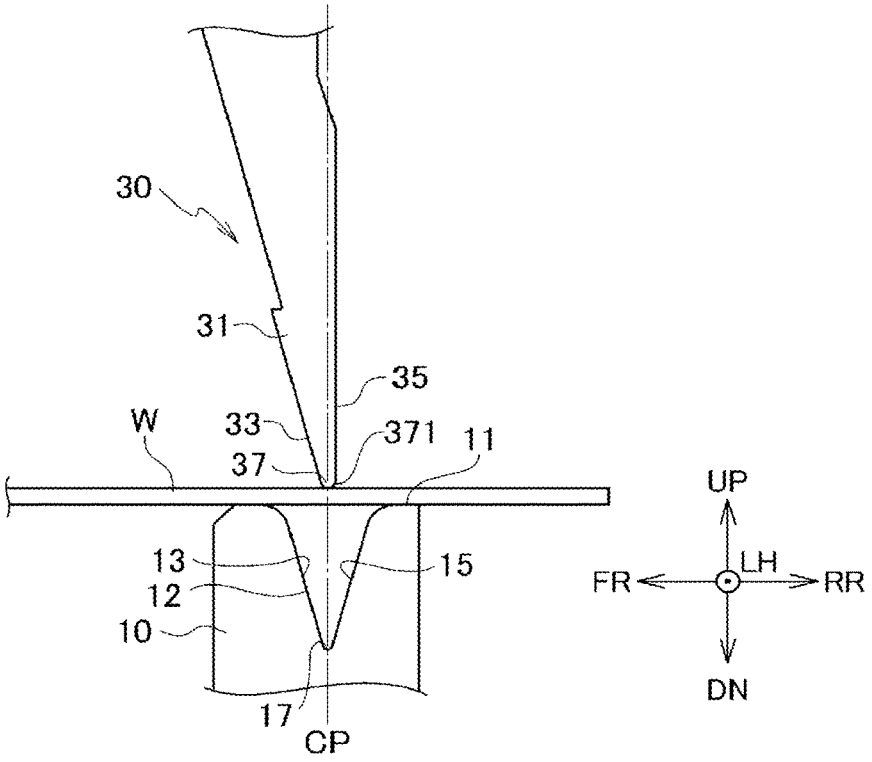
FIG. 2 is a diagram showing a state in which a workpiece W is positioned and placed on the die 10 for bending.
Figure 3:
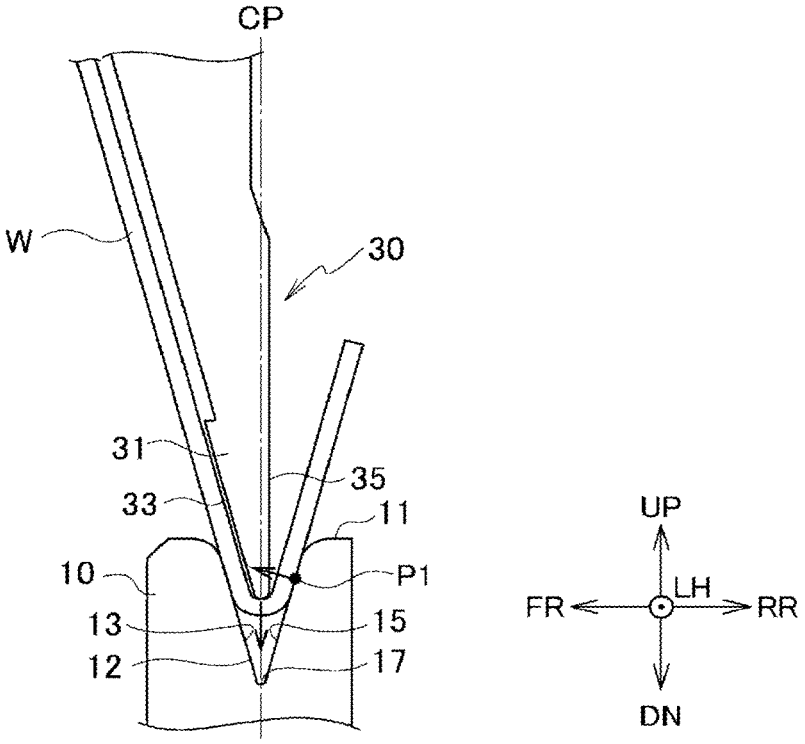
FIG. 3 is a diagram showing a working process of the bending of the workpiece W.
Figure 4:
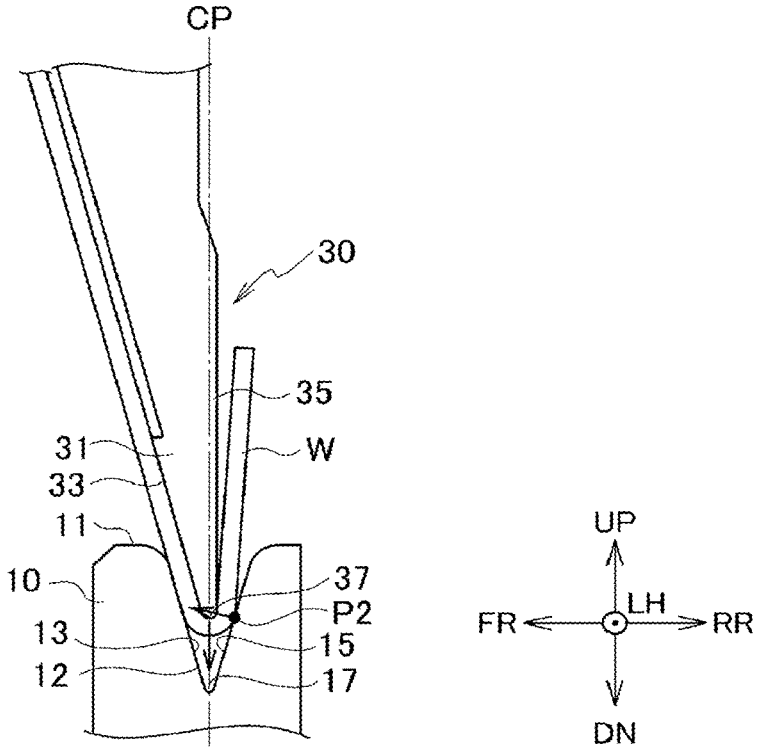
FIG. 4 is a diagram showing a completed state of the bending of the workpiece W.

FIG. 2 is a diagram showing a state in which the plate-shaped workpiece W is positioned and placed on the die 10 for the bending. FIG. 3 is a diagram showing a working process of the bending of the plate-shaped workpiece W. FIG. 4 is a diagram showing a completed state of the bending of the plate-shaped workpiece W.

As shown in FIG. 2, in the bending method of the plate-shaped workpiece W according to the present embodiment, the die 10 and the punch 30 for the bending are used. Then, the plate-shaped workpiece W to be bent is placed on the upper part 11 of the die 10. As shown in FIG. 3, the plate-shaped workpiece W placed on the upper part 11 of the die 10 is pressed by the punch 30 from an upper surface side thereof. When the plate-shaped workpiece W is pressed by the punch 30, as shown in FIG. 4, the punch 30 advances to the V-groove 12 up to a position at which the plate-shaped workpiece W comes in contact with the first groove wall surface 13 of the V-groove 12 and the first surface 33 of the punch 30. Thereby, the plate-shaped workpiece W is bent in a state of being sandwiched between the first groove wall surface 13 and the first surface 33.

Specifically, as shown in FIG. 2, the plate-shaped workpiece W is placed on the upper part 11 of the die 10. Then, the punch 30 is lowered to and pressed against the plate-shaped workpiece W. At this time, in the plate-shaped workpiece W, the bending is started from a state in which a bottom surface thereof shown in FIG. 2 comes into contact with the upper part 11 of the die 10 and the upper surface thereof comes into contact with the tip 371 of the punch 30.

As shown in FIG. 3, the punch 30 is lowered via the upper table 130 to press the plate-shaped workpiece W by the workpiece pressing portion 31. In a state shown in FIG. 3, the workpiece pressing portion 31 is pressing the plate-shaped workpiece W while being advancing to the V-groove 12. As a result of this, the bottom surface of the plate-shaped workpiece W, which has been in contact with the upper part 11 before the start of the pressing, is brought into a state of being in contact with the first groove wall surface 13 and the second groove wall surface 15 of the V-groove 12. In other words, as the workpiece pressing portion 31 advances to the V-groove 12, the position of the die 10 that supports the bottom surface of the plate-shaped workpiece W moves from the upper part 11 of the die 10 to the second groove wall surface 15 (or the first groove wall surface 13).

Further, in a state of FIG. 4, the workpiece pressing portion 31 is further lowered until the plate-shaped workpiece W is sandwiched between the first groove wall surface 13 of the V-groove 12 and the first surface 33 of the punch 30, so as to press and bend the plate-shaped workpiece W.

At this time, the position at which the bottom surface of the plate-shaped workpiece W comes into contact with the second groove wall surface 15 is a cross section perpendicular to the lateral direction, and moves from a contact position P1 in the state of FIG. 3 to a contact position P2 in the state of FIG. 4 in which the workpiece pressing portion 31 is further advanced to the V-groove 12.

While the upper surface of the plate-shaped workpiece W is being pressed downward by the tip 371 of the workpiece pressing portion 31 at a position on the first perpendicular plane CP, the bottom surface thereof continues to receive a reaction force in a normal direction orthogonal to the second groove wall surface 15 from the moving contact positions P1 and P2 with the second groove wall surface 15. Therefore, on the second side SS, the plate-shaped workpiece W above the contact position P2 is separated from the second groove wall surface 15 and bent toward a side of the first perpendicular plane CP. In other words, the plate-shaped workpiece W is bent until the angle formed with the perpendicular plane is smaller than the angle ($\theta v/2$) formed between the first vertical surface CP and the second groove wall surface 15 and is larger than the angle $\theta 2$ formed between the perpendicular plane and the second surface 35 on the second side SS.

On the other hand, on the first side FS, as shown in FIG. 4, since the first surface 33 is parallel to the first groove wall surface 13, the plate-shaped workpiece W is bent in the state of being sandwiched between the first groove wall surface 13 and the first surface 33. Therefore, on the first side FS, even if the bottom surface of the plate-shaped workpiece W receives the reaction force from the first groove wall surface 13, the plate-shaped workpiece W is abutted against the first surface 33 of the workpiece pressing portion 31. Therefore, the plate-shaped workpiece W is not bent toward the side of the first perpendicular plane CP beyond the angle $\theta v/2$ formed between the first groove wall surface 13 and the first perpendicular plane CP.

As a result, the plate-shaped workpiece W is bent at an angle smaller than the angle $\theta v$ of the angle formed between the first groove wall surface 13 and the second groove wall surface 15 of the V-groove 12 of the die 10. Note that when it is preferable to ensure the flatness of the first side FS of the plate-shaped workpiece W after processing, the workpiece pressing portion 31 may be advanced to the V-groove 12 up to a position at which the plate-shaped workpiece W is brought into a surface contact with the first groove wall surface 13 and the first surface 33.

(4) Actions and Effects

The bending method of the present embodiment utilizes the die 10 mountable on the lower table 110 of the press brake 100 and including the V-groove 12 including the first groove wall surface 13 and the second groove wall surface 15 at the upper part 11, and the punch 30 mountable on the upper table 130 of the press brake 100 and including, at the workpiece pressing portion 31, the first surface 33 and the second surface 35, the first surface 33 in the state of being mounted on the upper table 130 being parallel to the first groove wall surface 13 of the die 10 in the state of being mounted on the lower table 110, the angle θ2 formed between the second surface 35 and the perpendicular plane being different from the angle formed between the second groove wall surface 15 and the perpendicular plane.

The plate-shaped workpiece W is placed on the upper part 11 of the die 10 mounted on the lower table 110 of the press brake 100.

The plate-shaped workpiece W is pressed by the workpiece pressing portion 31 of the punch 30 mounted on the upper table 130 of the press brake 100, and is bent in the state in which the plate-shaped workpiece W is sandwiched between the first groove wall surface 13 of the V-groove 12 and the first surface 33 of the punch.

According to this configuration, the plate-shaped workpiece W is bent at the angle smaller than the angle θv of the angle formed between the first groove wall surface 13 and the second groove wall surface 15 of the V-groove 12 of the die 10. In other words, it is possible to bend the plate-shaped workpiece W, without using a dedicated die or the like, to an angle smaller than the angle θv formed between the groove wall surfaces 13 and 15 of the V-groove 12.

Particularly, the bending method of the present embodiment can be used in a case in which the material of the plate-shaped workpiece W is a SUS with a thickness of 1.5 mm or more and 2.0 mm or less or an SPCC with a thickness of 2.0 mm or more and 2.3 mm or less. As in the conventional art, for example, when the hemming is performed to the workpiece W after being bent at an acute angle with a bent portion of the workpiece W up to about 30°, a thrust load generated to the workpiece in finish bending during the hemming, in other words, a force pushing the workpiece forward is increased if a thick plate having a high bending rigidity of the plate-shaped workpiece W is used. As a result, there is a possibility that workability of the hemming is lowered. Furthermore, there is a possibility that the workpiece may be misaligned with respect to the die during the processing, resulting in a decrease in bending accuracy.

However, if the bending method of the present embodiment is used when the plate-shaped workpiece W is bent at an acute angle, it is possible to bend the plate-shaped workpiece W at an acute angle up to an angle smaller than the angle θv formed between the groove wall surfaces 13 and 15 of the V-groove 12. Therefore, this acute-angle bending can reduce the thrust load to the plate-shaped workpiece W, which is generated when the finish bending such as the hemming is performed.

Furthermore, in the present bending method, since the acute angle bending can be performed in one step without using the dedicated die, working efficiency of the bending such as the hemming of the plate-shaped workpiece W can be improved, and cost reduction can also be achieved by not using the dedicated die.

Furthermore, in the bending method of the present embodiment, the plate-shaped workpiece W is bent to the state of being sandwiched between the first surface 33 of the workpiece pressing portion 31 and the first groove wall surface 13 of the V-groove 12. Therefore, the flatness of a plate-shaped structure of the plate-shaped workpiece W on the first side FS is stably ensured even after the bending.

In addition, in the bending method of the present embodiment, merely by setting the angle θ2 with respect to the perpendicular plane of the second surface 35 connected to the distal end 37 formed symmetrically with respect to the first perpendicular plane CP, the plate-shaped workpiece W can be bent at a desired angle smaller than the angle θv formed between the groove wall surfaces 13 and 15 of the V-groove 12.

(5) Modified Example

(5.1) Modified Example of Punch

In the present embodiment, in the state in which the punch 30 is mounted on the upper table 130, the second surface 35 of the workpiece pressing portion 31 of the punch 30 is parallel to the perpendicular plane as shown in FIG. 1B. However, the configuration of the second surface 35 is not limited to this. In other words, the second surface 35 may not be parallel to the perpendicular plane.

Figure 5A:
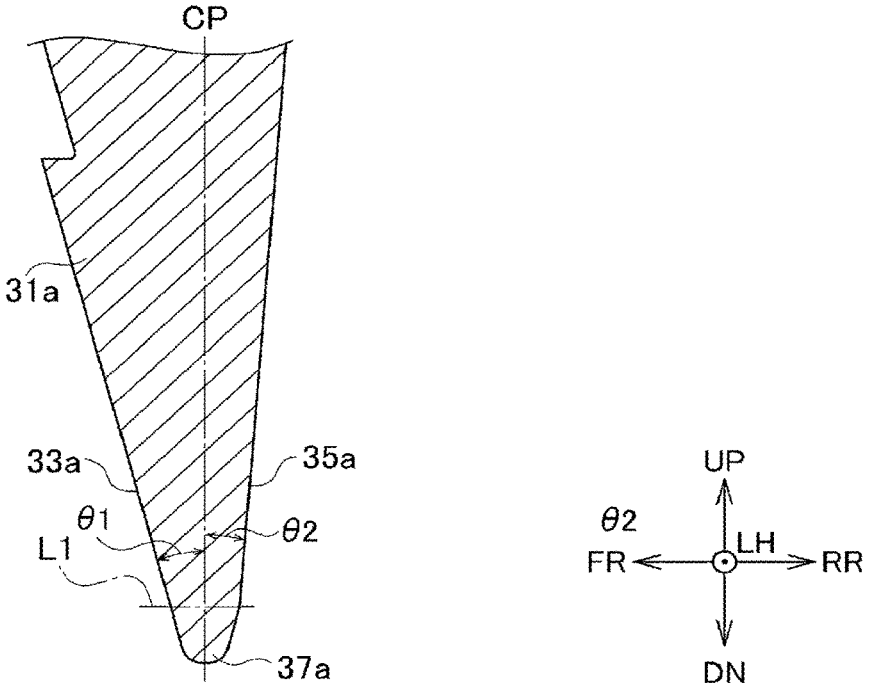
FIG. 5A is a diagram showing a modified example of the present embodiment, and is an enlarged cross-sectional view including a workpiece pressing portion of a punch 31*a*.
Figure 5B:
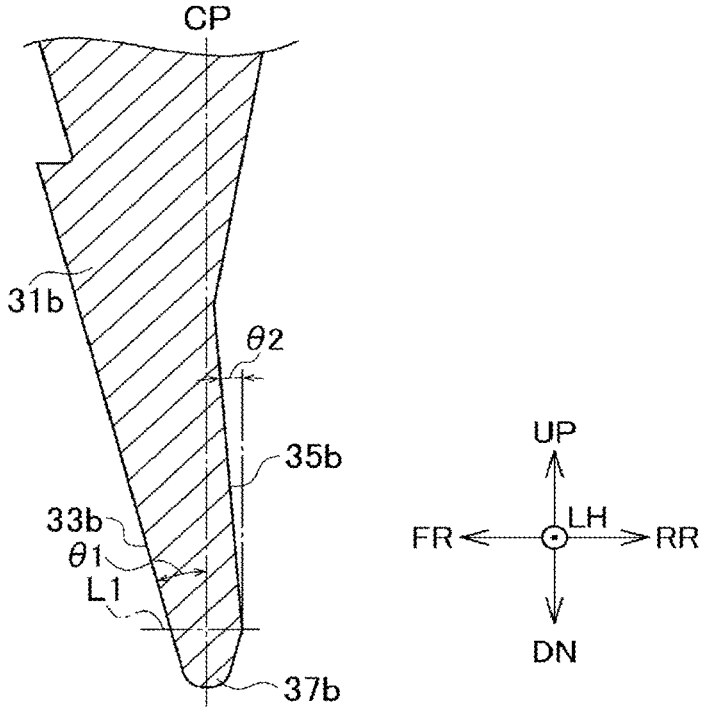
FIG. 5B is a diagram showing a modified example of the present embodiment, and is an enlarged cross-sectional view including a workpiece pressing portion of a punch 31*b*.

In modified examples of FIGS. 5A and 5B, the respective shapes of distal ends 37*a* and 37*b* are made similar to the shape of the distal end 37 of the present embodiment. Furthermore, an angle θ1 of each of first surfaces 33*a* and 33*b* is the same as the angle θ1 of the first surface 33 of the present embodiment.

On the other hand, the angle θ2 of the angle formed between a second surface 35*a* shown in FIG. 5A and the perpendicular plane including the lateral direction is set to be larger than 0° and less than 15°. Further, when an inclination angle of the second groove wall surface 15 of the V-groove 12 with respect to the perpendicular plane is a positive angle, the angle θ2 of the angle formed between a second surface 35*b* shown in FIG. 5B and the perpendicular plane including the lateral direction is set to be a negative angle. In other words, the angle θ2 is set to be less than 0° and −15° or more.

Note that according to the configuration of a workpiece pressing portion 31*a* of the punch 30 shown in FIG. 5A, when being bent, the plate-shaped workpiece W can be prevented from being bent at an excessively acute angle in a range of an angle smaller than the angle θv formed between the groove wall surfaces 13 and 15 of the V-groove 12 by bringing the second surface 35*a* into contact with a bent portion of the workpiece W.

Further, according to the configuration of a workpiece pressing portion 31*b* of the punch 30 shown in FIG. 5B, when being bent, the plate-shaped workpiece W can be bent to an angle sufficiently smaller than the angle θv formed between the groove wall surfaces 13 and 15 of the V-groove 12.

In addition, the distal end 37 of the workpiece pressing portion 31 of the present embodiment shown in FIG. 1B is formed symmetrically with respect to the first perpendicular plane CP in the state in which the punch 30 is mounted on the upper table 130. However, as shown in FIG. 5C, a distal end 37*c* of the punch 30 may be asymmetric with respect to the first perpendicular plane CP.

Figure 5C:
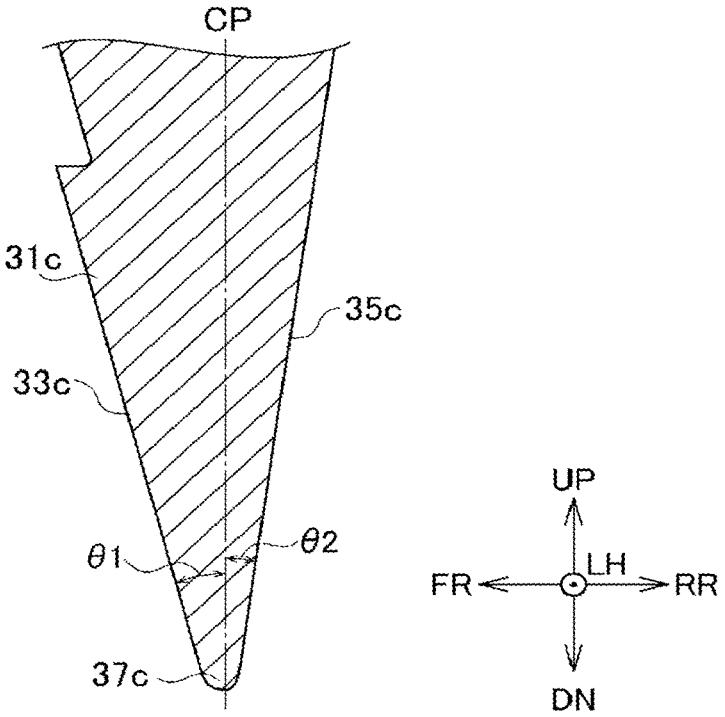
FIG. 5C is a diagram showing a modified example of the present embodiment, and is an enlarged cross-sectional view including a workpiece pressing portion of a punch 31*c*.

In a modified example of FIG. 5C, the angle θ1 of a first surface 33*c* on the first side FS is set to have the same shape as that of the present embodiment. On the other hand, the angle θ2 formed between a second surface 35*c* and the perpendicular plane including the lateral direction on the second side SS is set to be larger than 0° and less than 15°.

Furthermore, the distal end 37*c* is shaped asymmetrically with respect to the first perpendicular plane CP. Specifically, the distal end 37*c* on the first side FS with respect to the first perpendicular plane CP is set to have the same shape as that of the present embodiment. On the other hand, on the second side SS with respect to the first perpendicular plane CP, the cross-sectional shape of a cross section perpendicular to the lateral direction of the tip 371 is an arc shape with a smaller radius than that of the first side FS, and the distal end 37*c* is smoothly continuous with the second surface 35*c* in the tangential direction of the arc-shaped portion of the cross section.

According to the configuration of the distal end 37*c* of the punch 30 shown in FIG. 5C, when being bent, the plate-shaped workpiece W can be bent to the angle sufficiently smaller than the angle θv formed between the groove wall surfaces 13 and 15 of the V-groove 12. Furthermore, since a distance in the front-back direction is sufficiently ensured from a position at which the distal end 37*c* of the punch and one surface of the workpiece W come in contact with the second groove wall surface 15, even if the length of a portion of the workpiece W to be bent is short, the workpiece W can be reliably bent to a desired acute angle.

(5.2) Modified Example of Die

As shown in FIG. 1A, the configuration of the die 10 in which the V-groove 12 is directly formed at the upper part 11 is described as the die 10 used in the bending method of the present embodiment. However, the die 10 for the bending that can be used in the bending method of the present embodiment is not limited to this. For example, the die 10 may be a double-deck die 50 for the hemming bending shown in FIG. 6.

Figure 6:
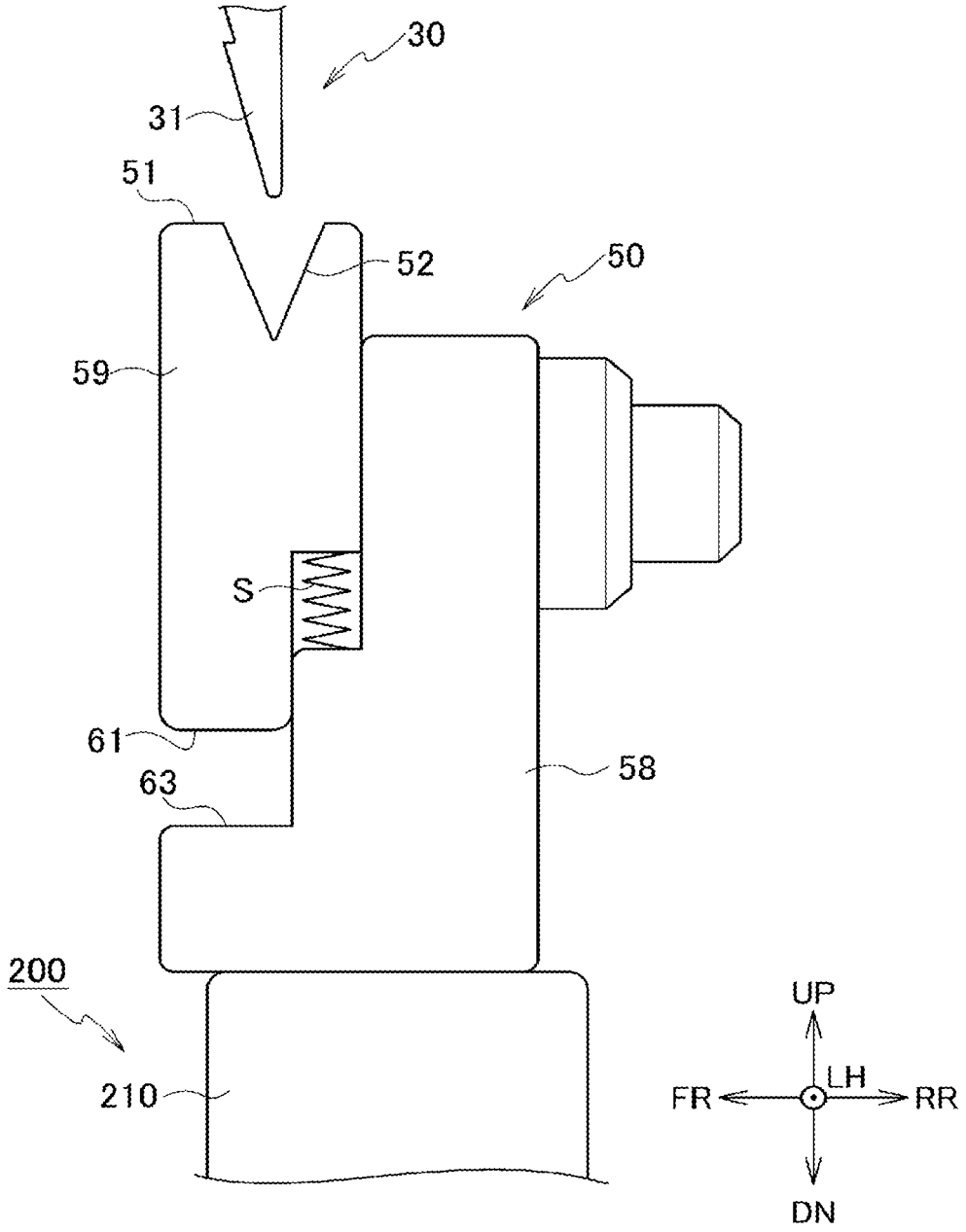
FIG. 6 is a side view showing a modified example of a die 50 for the bending according to the present embodiment, and is a diagram showing an example in which the die 50 is a double-deck die for hemming.

Specifically, the double-deck die 50 for the hemming shown in FIG. 6 includes a die base 58 supported by a lower table 210 of a press brake 200, and a movable die 59 that can be moved vertically with respect to the die base 58. The movable die 59 is constantly urged upward by an urging means S such as a coil spring.

At an upper part 51 of the movable die 59, a V-groove 52 having an acute-angled groove bottom is formed for bending the plate-shaped workpiece W at an acute angle. Note that in the present modified example, the shape of the V-groove 52 is the same as the shape of the V-groove 12 of the present embodiment.

Then, a bottom surface 61 of the movable die 59 and a flat surface 63 of the die base 58 are provided so as to be vertically opposed to each other to crush a flange portion of the workpiece W bent at an acute angle. Note that the press brake 200 is configured in the same manner as the press brake 100 of the present embodiment except that the lower table 210 is configured to be able to support the double-deck die 50.

When the plate-shaped workpiece W is bent by using the double-deck die 50 having the above configuration, the plate-shaped workpiece W is first placed on the movable die 59. Then, the workpiece W is pressed by the workpiece pressing portion 31 of the punch 30. At this time, the movable die 59 is lowered against the urging means S, and the bottom surface 61 of the movable die 59 and the flat surface 63 of the die base 58 come into contact with each other. Then, the workpiece W is pressed against the V-groove 52 so that the workpiece W is preliminarily bent at an acute angle.

The hemming (the finish bending) by the double-deck die 50 for the hemming is performed by removing the preliminarily bent workpiece W and placing, between the flat surface 63 of the die base 58 and the bottom surface 61 of the movable die 59, a portion (a bent portion) of the workpiece W bent at an acute angle. Then, the punch 30 is caused to be engaged with the V-groove 52 of the movable die 59 to press the movable die 59 downward. In the double-deck die 50, the punch 30 can be directly engaged with the V-groove 52 of the movable die 59 to strongly press the movable die 59.

When the plate-shaped workpiece is preliminary bent by the bending method of the present embodiment using the double-deck die 50 having the above configuration, as in the case of using the die 10 of the present embodiment, it is possible to reduce the thrust load to the workpiece that is generated during the hemming, that is, the force that pushes the workpiece forward without using the dedicated die. Furthermore, since it is possible to perform the hemming (the finish bending) without changing the die or the like, the work efficiency of crushing of the bent portion of the workpiece W is improved.

Note that the shapes of the V-groove 12 formed at the respective upper parts 11 and 51 of the dies 10 and 50 of the present embodiment are symmetrical with respect to the first perpendicular plane CP. However, the shape of the V-groove 12 is not limited to this. In other words, the groove wall of the V-groove 12 may be asymmetric with respect to the first perpendicular plane CP.

Although the embodiment and a plurality of modified examples of the present invention have been described above, the statements and drawings forming a part of the present disclosure should not be understood to limit the present invention. Various alternative embodiments, examples, and operational techniques will become apparent to those skilled in the art from the present disclosure.

The entire contents of Japanese Patent Application 2021-007214 (filing date: Jan. 20, 2021) are incorporated herein.

The invention claimed is:

1. A bending method of bending a plate-shaped workpiece with use of: a die mounted on a lower table of a press brake and including a V-groove having a first groove wall surface and a second groove wall surface at an upper part thereof, and a punch mounted on an upper table of the press brake and including, at a workpiece pressing portion, a first surface, a second surface, and a distal end, the first surface of the punch being parallel to the first groove wall surface of the die the distal end of the punch being provided with a tip at a lower end of the distal end, neighboring planar portions, the planar portions being continuous with the first surface and parallel to the first groove wall surface and the second groove wall surface in a state in which the punch is advanced into the V-groove, the method comprising the steps of:

placing the plate-shaped workpiece on the upper part of the die mounted on the lower table of the press brake; and pressing the plate-shaped workpiece by the workpiece pressing portion of the punch mounted on the upper table of the press brake so as to bend the plate-shaped workpiece when sandwiched between the first groove wall surface of the V-groove and the first surface of the punch, wherein an angle formed between the second surface and a perpendicular plane is different from an angle formed between the second groove wall surface and the perpendicular plane, and the plate-shaped workpiece is bent apart from the second groove wall surface and toward a side of the perpendicular plane.

2. The bending method according to claim 1, wherein at the workpiece pressing portion, the distal end connecting the first surface and the second surface is symmetrically formed with respect to the perpendicular plane passing through an intersect position at which imaginary planes extending downward along the respective first groove wall surface and second groove wall surface intersect with each other in a state in which the punch is mounted on the upper table.

3. The bending method according to claim 1, wherein at the workpiece pressing portion, the distal end connecting the first surface and the second surface is asymmetrically formed with respect to the perpendicular plane passing through an intersect position at which imaginary planes extending downward along the respective first groove wall surface and second groove wall surface intersect with each other in a state in which the punch is mounted on the upper table.

4. The bending method according to claim 1, wherein an angle formed between the first groove wall surface and the second groove wall surface of the V-groove is an acute angle.

* * * * *